US008684685B2

(12) United States Patent
Delvaux

(10) Patent No.: US 8,684,685 B2
(45) Date of Patent: Apr. 1, 2014

(54) ROTARY MACHINE HAVING GROOVES FOR CONTROL OF FLUID DYNAMICS

(75) Inventor: John McConnell Delvaux, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 641 days.

(21) Appl. No.: 12/908,839

(22) Filed: Oct. 20, 2010

(65) Prior Publication Data

US 2012/0099996 A1 Apr. 26, 2012

(51) Int. Cl.
*F01D 5/02* (2006.01)

(52) U.S. Cl.
USPC ..... 415/195; 415/194; 416/219 R

(58) Field of Classification Search
USPC ..... 416/176, 203, 119 R, 220 R, 212 A; 415/194, 195, 209.1
See application file for complete search history.

(56) References Cited

U.S. PATENT DOCUMENTS 1,534,721 A 4/1925 Lasche
2,916,257 A * 12/1959 Poellmitz et al. ..... 416/220 R
3,006,603 A * 10/1961 Caruso et al. ..... 415/195
3,107,897 A * 10/1963 Judge et al. ..... 416/191
4,084,922 A * 4/1978 Glenn ..... 416/220 R
4,175,912 A * 11/1979 Crane et al. ..... 416/193 A
4,474,534 A 10/1984 Thode
5,000,660 A 3/1991 Van Houten et al.
5,681,145 A 10/1997 Neely et al.
6,402,458 B1 * 6/2002 Turner ..... 415/1
6,439,838 B1 8/2002 Crall et al.
6,733,237 B2 * 5/2004 Ingistov ..... 415/209.2
7,029,227 B2 4/2006 Berthillier et al.
7,367,775 B2 * 5/2008 Borufka et al. ..... 415/119
7,743,497 B2 6/2010 Gautreau et al.
7,931,442 B1 * 4/2011 Liang ..... 416/193 A
8,206,097 B2 * 6/2012 Nagai et al. ..... 415/195
8,277,166 B2 * 10/2012 Tecza et al. ..... 415/1
2007/0079506 A1 4/2007 Gautreau et al.
2008/0112809 A1 * 5/2008 Corral Garcia et al. ..... 416/189
2009/0047128 A1 * 2/2009 Bracken et al. ..... 416/1

* cited by examiner

*Primary Examiner* — Nathaniel Wiehe
*Assistant Examiner* — Justin Seabe
(74) *Attorney, Agent, or Firm* — Fletcher Yoder P.C.

(57) ABSTRACT

A system includes a rotary machine including, a stator, a rotor configured to rotate relative to the stator, a plurality of axial grooves disposed along a circumference of the stator or the rotor, a plurality of blade segments disposed along the circumference, wherein each blade segment of the plurality of blade segments comprises a blade coupled to a mounting base supported in a respective axial groove of the plurality of axial grooves, and the plurality of blades has a non-uniform blade spacing about the circumference.

18 Claims, 8 Drawing Sheets

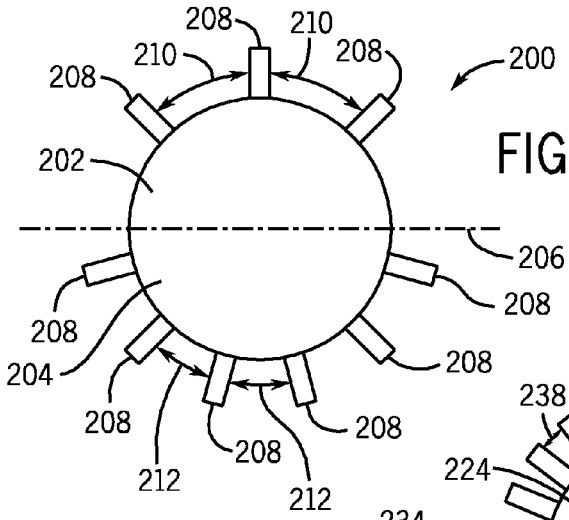
FIG. 2
FIG. 3
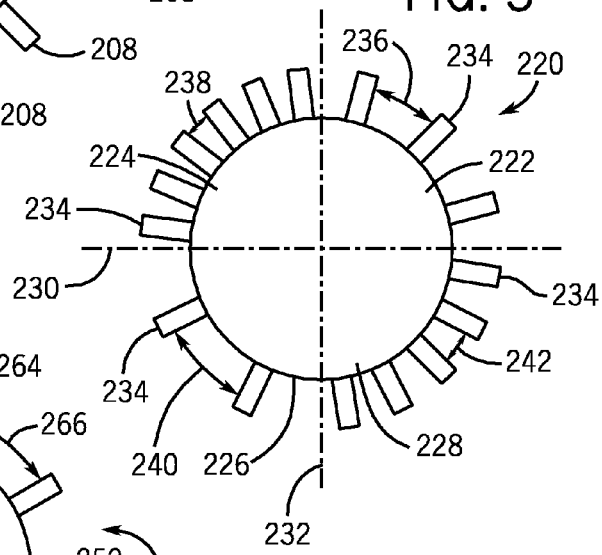
FIG. 4
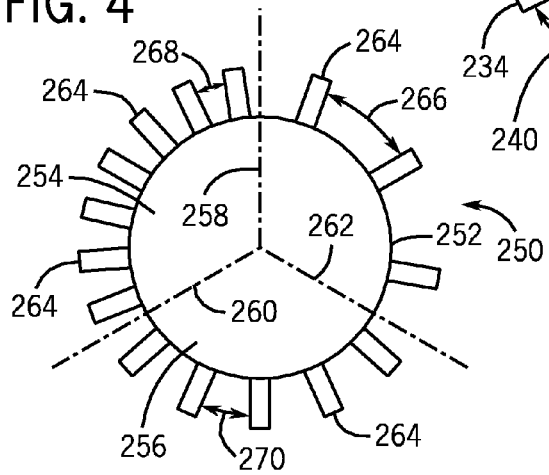
FIG. 5
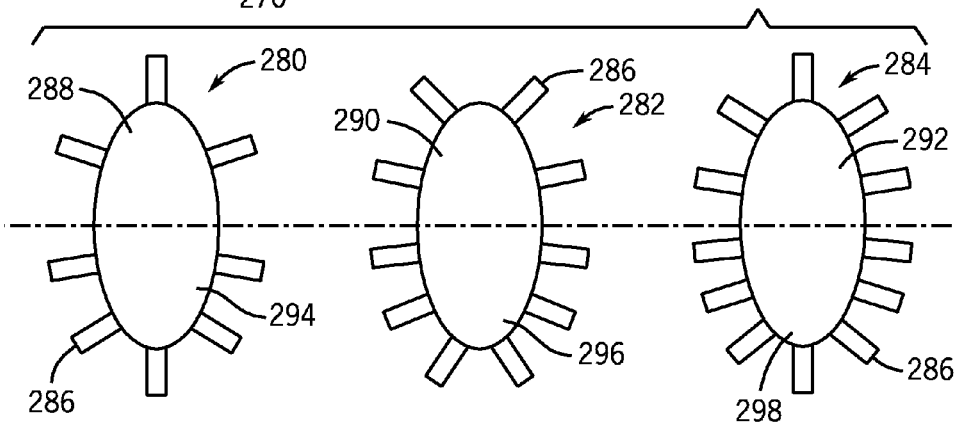

570

ROTARY MACHINE HAVING GROOVES FOR CONTROL OF FLUID DYNAMICS

BACKGROUND OF THE INVENTION

The subject matter disclosed herein relates to rotary machines and, more particularly, turbines and compressors having blades disposed about a rotor or vanes disposed about a stator.

Turbine engines extract energy from a flow of fluid and convert the energy into useful work. For example, a gas turbine engine combusts a fuel-air mixture to generate hot combustion gases, which then flow through turbine blades to drive a rotor. Unfortunately, the rotating turbine blades create wake and bow waves, which can excite structures in the gas turbine engine. For example, the wake and bow waves may cause vibration, premature wear, and damage of vanes, nozzles, airfoils, and other structures in the flow path of the hot combustion gases. Furthermore, the periodic nature of the wake and bow waves may create resonant behavior in the gas turbine engine, thereby producing increasingly larger amplitude oscillations in the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a rotary machine including, a stator, a rotor configured to rotate relative to the stator, a plurality of axial grooves disposed along a circumference of the stator or the rotor, a plurality of blade segments disposed along the circumference, wherein each blade segment of the plurality of blade segments comprises a blade coupled to a mounting base supported in a respective axial groove of the plurality of axial grooves, and the plurality of blades has a non-uniform blade spacing about the circumference.

In a second embodiment, a system includes a rotary machine including, a plurality of first axial mounts disposed circumferentially about a rotational axis, a plurality of second axial mounts disposed circumferentially about the rotational axis, wherein each first axial mount couples with a respective second axial mount in an axial direction along the rotational axis, and a plurality of blades coupled to the plurality of second axial mounts, wherein the plurality of blades has a non-uniform blade spacing circumferentially about the rotational axis.

In a third embodiment, a system includes a turbo machine including, a stator, a rotor configured to rotate relative to the stator, a plurality of axial grooves disposed along a circumference of the rotor, and a plurality of blades coupled to the plurality of axial grooves, wherein the plurality of blades is disposed in a fluid flow path between the rotor and the stator, and the plurality of blades has a non-uniform blade spacing along the circumference.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 2 is a front view of an embodiment of a rotor with a non-uniform spacing of blades;

FIG. 3 is a front view of an embodiment of a rotor with a non-uniform spacing of blades;

FIG. 4 is a front view of an embodiment of a rotor with a non-uniform spacing of blades;

FIG. 5 is a perspective view of an embodiment of three rotors, wherein each rotor has a different non-uniform spacing of blades;

DETAILED DESCRIPTION OF THE INVENTION

Figure 1:
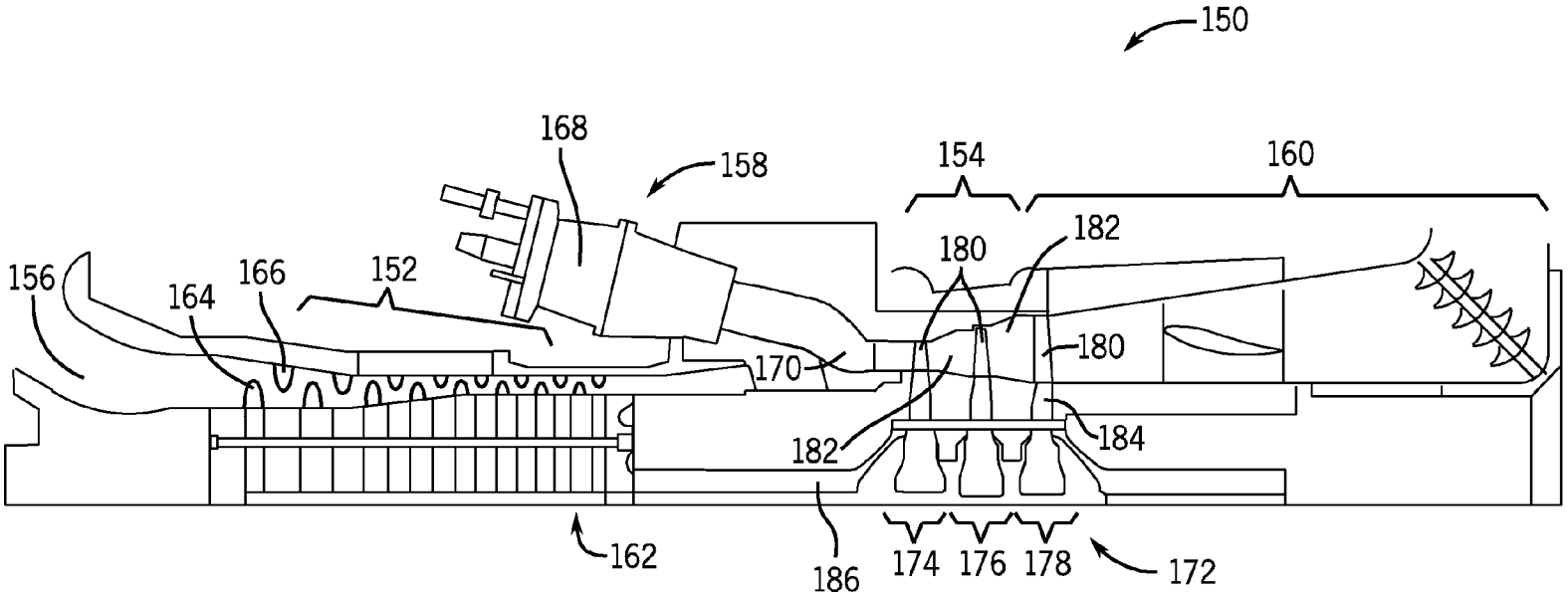
FIG. 1 is a sectional view of an embodiment of a gas turbine engine of FIG. 1 sectioned through the longitudinal axis.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed to a non-uniform spacing of blades in a rotary machine or tubo machine, such as a turbine or a compressor, to reduce the development of wake and bow waves. As discussed below, the non-uniform spacing of the blades reduces or eliminates the periodic nature of the wake and bow waves, thereby reducing the possibility of resonant behavior in the rotary machine. In other words, the non-uniform spacing of the blades and vanes may reduce or eliminate the ability of the wake and bow waves to increase in amplitude due to a periodic spacing of the blades and vanes, and thus, a periodic driving force of the wake and bow waves. Instead, the non-uniform spacing of the blades and vanes may dampen and reduce the response of other rotating and stationary airfoils or structures caused by the wake and bow waves, due to their non-periodic generation. In certain embodiments, the non-uniform spacing of the blades may be achieved with differently sized spacers between adjacent blades, differently sized bases of adjacent blades, non-uniform spacing between axial grooves, shifting the position of an air foil on top of its base, use of axial mounts that shift an airfoil base and its airfoil, or any combination thereof. The non-uniform spacing of the blades may include both non-uniform spacing of the blades about a circumference of a particular stage (e.g., turbine or compressor stage), non-uniform spacing of the blades from one stage to another, or a combination thereof. The non-uniform blade spacing effectively reduces and dampens the wake and bow waves generated by the rotating blades, thereby reducing the possibility of vibration, premature wear, and damage caused by such wake and bow waves on rotating and stationary airfoils or structures. While the following embodiments are discussed in the context of a gas turbine, it is understood that any turbine may employ non-uniform blade spacing to dampen and reduce resonant behavior in stationary parts. Furthermore, the disclosure is intended to cover rotary machines that move fluids other than air such as water, steam, etc.

The disclosed embodiments of non-uniform spacing or modified count of rotating blades or stationary vanes may be utilized in any suitable rotary machine, such as turbines, compressors, and rotary pumps. However, for purposes of discussion, the disclosed embodiments are presented in context of a gas turbine engine. FIG. 1 is a cross-sectional side view of an embodiment of a gas turbine engine 150. As described further below, a non-uniform spacing or modified count of rotating blades or stationary vanes may be employed within the gas turbine engine 150 to reduce and/or dampen periodic oscillations, vibration, and/or harmonic behavior of wake and bow waves in the fluid flow. For example, a non-uniform spacing or modified count of rotating blades or stationary vanes may be used in a compressor 152 and a turbine 154 of the gas turbine engine 150. Furthermore, the non-uniform spacing or modified count of rotating blades or stationary vanes may be used in a single stage or multiple stages of the compressor 152 and the turbine 154, and may vary from one stage to another.

In the illustrated embodiment, the gas turbine engine 150 includes an air intake section 156, the compressor 152, one or more combustors 158, the turbine 154, and an exhaust section 160. The compressor 152 includes a plurality of compressor stages 162 (e.g., 1 to 20 stages), each having a plurality of rotating compressor blades 164 and stationary compressor vanes 166. The compressor 152 is configured to intake air from the air intake section 156 and progressively increase the air pressure in the stages 162. Eventually, the gas turbine engine 150 directs the compressed air from the compressor 152 to the one or more combustors 158. Each combustor 158 is configured to mix the compressed air with fuel, combust the fuel air mixture, and direct hot combustion gases toward the turbine 154. Accordingly, each combustor 158 includes one or more fuel nozzles 168 and a transition piece 170 leading toward the turbine 154. The turbine 154 includes a plurality of turbine stages 172 (e.g., 1 to 20 stages), such as stages 174, 176, and 178, each having a plurality of rotating turbine blades 180 and stationary nozzle assemblies or turbine vanes 182. In turn, the turbine blades 180 are coupled to respective turbine wheels 184, which are coupled to a rotating shaft 186. The turbine 154 is configured to intake the hot combustion gases from the combustors 158, and progressively extract energy from the hot combustion gases to drive the blades 180 in the turbine stages 172. As the hot combustion gases cause rotation of the turbine blades 180, the shaft 186 rotates to drive the compressor 152 and any other suitable load, such as an electrical generator. Eventually, the gas turbine engine 150 diffuses and exhausts the combustion gases through the exhaust section 160.

As discussed in detail below, a variety of embodiments of non-uniform spacing or modified count of rotating blades or stationary vanes may be used in the compressor 152 and the turbine 154 to tune the fluid dynamics in a manner that reduces undesirable behavior, such as resonance and vibration. For example, as discussed with reference to FIGS. 2-14, a non-uniform spacing of the compressor blades 164, the compressor vanes 166, the turbine blades 180, and/or the turbine vanes 182 may be selected to reduce, dampen, or frequency shift the wake and bow waves created in the gas turbine engine 150. Similarly, as discussed with reference to FIGS. 15-17, the blades and/or vanes are non-uniformly spaced because of non-uniform spacing of the grooves about the stator and/or rotor. Thus, the groove placement on the stator and/or rotor may be selected to reduce, dampen, or frequency shift the wake and bow waves created in the gas turbine engine 150. Furthermore, as discussed with reference to FIGS. 18-22, moving the blade on the blade base may non-uniformly space the blades while maintaining uniform spacing of the blade bases and grooves. Thus, reducing, dampening, or frequency shifting the wake and bow waves created in the turbine 150. Finally, as discussed in reference to FIGS. 23-25, a blade mounting adapter may non-uniformly space blades by shifting the airfoil base and the corresponding airfoil within uniformly spaced grooves. This reduces, dampens, or frequency shifts the wake and bow waves created in the turbine, thereby improving the performance and increasing the longevity of the gas turbine engine 150.

FIG. 2 is a front view of an embodiment of a rotor 200 with non-uniformly spaced blades. In certain embodiments, the rotor 200 may be disposed in a turbine, a compressor, or another rotary machine. For example, the rotor 200 may be disposed in a gas turbine, a steam turbine, a water turbine, or any combination thereof. Furthermore, the rotor 200 may be used in multiple stages of a rotary machine, each have the same or different arrangement of the non-uniformly spaced blades.

The illustrated rotor 200 has non-uniformly spaced blades 208, which may be described by dividing the rotor 200 into two equal sections 202 and 204 (e.g., 180 degrees each) via an intermediate line 206. In certain embodiments, each section 202 and 204 may have a different number of blades 208, thereby creating non-uniform blade spacing. For example, the illustrated upper section 202 has three blades 208, while the illustrated lower section 204 has six blades 208. Thus, the upper section 202 has half as many blades 208 as the lower section 204. In other embodiments, the upper and lower sections 202 and 204 may differ in the number of blades 208 by approximately 1 to 1.005, 1 to 1.01, 1 to 1.02, 1 to 1.05, or 1 to 3. For example, the percentage of blades 208 of the upper section 202 relative to the lower section 204 may range between approximately 50 to 99.99 percent, 75 to 99.99 percent, 95 to 99.99, or 97-99.99 percent. However, any difference in the number of blades 208 between the upper and lower sections 202 and 204 may be employed to reduce and dampen wake and bow waves associated with rotation of the blades 208 on stationary airfoils or structures.

In addition, the blades 208 may be evenly or unevenly spaced within each section 202 and 204. For example, in the illustrated embodiment, the blades 208 in the upper section 202 are evenly spaced from one another by a first circumferential spacing 210 (e.g., arc lengths), while the blades 208 in the lower section 204 are evenly spaced from one another by a second circumferential spacing 212 (e.g., arc lengths). Although each section 202 and 204 has equal spacing, the circumferential spacing 210 is different from the circumferential spacing 212. In other embodiments, the circumferential spacing 210 may vary from one blade 208 to another in the upper section 202 and/or the circumferential spacing 212 may vary from one blade 208 to another in the lower section 204. In each of these embodiments, the non-uniform blade spacing is configured to reduce the possibility of resonance on stationary airfoils and structures due to periodic generation of wake and bow waves by rotating airfoils or structures. The non-uniform blade spacing may effectively dampen and reduce the wake and bow waves due to their non-periodic generation by the non-uniform rotating airfoils or structures. In this manner, the non-uniform blade spacing is able to lessen the impact of wake and bow waves on various downstream components, e.g., vanes, nozzles, stators, airfoils, etc.

FIG. 3 is a front view of an embodiment of a rotor 220 with non-uniformly spaced blades. In certain embodiments, the rotor 220 may be disposed in a turbine, a compressor, or another rotary machine. For example, the rotor 220 may be disposed in a gas turbine, a steam turbine, a water turbine, or any combination thereof. Furthermore, the rotor 220 may be used in multiple stages of a rotary machine, each have the same or different arrangement of the non-uniformly spaced blades.

The illustrated rotor 220 has non-uniformly spaced blades 234, which may be described by dividing the rotor 220 into four equal sections 222, 224, 226, and 228 (e.g., 90 degrees each) via intermediate lines 230 and 232. In certain embodiments, at least one or more of the sections 222, 224, 226, and 228 may have a different number of blades 234 relative to the other sections, thereby creating non-uniform blade spacing. For example, the sections 222, 224, 226, and 228 may have 1, 2, 3, or 4 different numbers of blades 234 in the respective sections. In the illustrated embodiment, each section 222, 224, 226, and 228 has a different number of blades 234. Section 222 has 3 blades equally spaced from one another by a circumferential distance 236, section 224 has 6 blades equally spaced from one another by a circumferential distance 238, section 226 has 2 blades equally spaced from one another by a circumferential distance 240, and section 228 has 5 blades equally spaced from one another by a circumferential distance 242. In this embodiment, sections 224 and 226 have an even yet different number of blades 234, while sections 222 and 228 have an odd yet different number of blades 234. In other embodiments, the sections 222, 224, 226, and 228 may have any configuration of even and odd numbers of blades 234, provided that at least one section has a different number of blades 234 relative to the remaining sections. For example, the sections 222, 224, 226, and 228 may vary in the number of blades 234 with respect to each other by approximately 1 to 1.005, 1 to 1.01, 1 to 1.02, 1 to 1.05, or 1 to 3.

In addition, the blades 234 may be evenly or unevenly spaced within each section 222, 224, 226, and 228. For example, in the illustrated embodiment, the blades 234 in the section 222 are evenly spaced from one another by the first circumferential spacing 236 (e.g., arc lengths), the blades 234 in the section 224 are evenly spaced from one another by the second circumferential spacing 238 (e.g., arc lengths), the blades 234 in the section 226 are evenly spaced from one another by the third circumferential spacing 240 (e.g., arc lengths), and the blades 234 in the section 228 are evenly spaced from one another by the fourth circumferential spacing 242 (e.g., arc lengths). Although each section 222, 224, 226, and 228 has equal spacing, the circumferential spacing 236, 238, 240, and 242 varies from one section to another. In other embodiments, the circumferential spacing may vary within each individual section. In each of these embodiments, the non-uniform blade spacing is configured to reduce the possibility of resonance due to periodic generation of wake and bow waves. Furthermore, the non-uniform blade spacing may effectively dampen and reduce the response of stationary airfoils or structures by the rotating airfoils or structure's wake and bow waves due to their non-periodic generation by the blades 234. In this manner, the non-uniform blade spacing is able to lessen the impact of wake and bow waves on various downstream components, e.g., vanes, nozzles, stators, airfoils, etc.

FIG. 4 is a front view of an embodiment of a rotor 250 with non-uniformly spaced blades. In certain embodiments, the rotor 250 may be disposed in a turbine, a compressor, or another rotary machine. For example, the rotor 250 may be disposed in a gas turbine, a steam turbine, a water turbine, or any combination thereof. Furthermore, the rotor 250 may be used in multiple stages of a rotary machine, each have the same or different arrangement of the non-uniformly spaced blades.

The illustrated rotor 250 has non-uniformly spaced blades 264, which may be described by dividing the rotor 250 into three equal sections 252, 254, and 256 (e.g., 120 degrees each) via intermediate lines 258, 260, and 262. In certain embodiments, at least one or more of the sections 252, 254, and 256 may have a different number of blades 264 relative to the other sections, thereby creating non-uniform blade spacing. For example, the sections 252, 254, and 256 may have 2 or 3 different numbers of blades 264 in the respective sections. In the illustrated embodiment, each section 252, 254, and 256 has a different number of blades 264. Section 252 has 3 blades equally spaced from one another by a circumferential distance 266, section 254 has 6 blades equally spaced from one another by a circumferential distance 268, and section 256 has 5 blades equally spaced from one another by a circumferential distance 270. In this embodiment, sections 252 and 256 have an odd yet different number of blades 264, while section 254 has an even number of blades 264. In other embodiments, the sections 252, 254, and 256 may have any configuration of even and odd numbers of blades 264, provided that at least one section has a different number of blades 264 relative to the remaining sections. For example, the sections 252, 254, and 256 may vary in the number of blades 264 with respect to each other by approximately 1 to 1.005, 1 to 1.01, 1 to 1.02, 1 to 1.05, or 1 to 3.

In addition, the blades 264 may be evenly or unevenly spaced within each section 252, 254, and 256. For example, in the illustrated embodiment, the blades 264 in the section 252 are evenly spaced from one another by the first circumferential spacing 266 (e.g., arc lengths), the blades 264 in the section 254 are evenly spaced from one another by the second circumferential spacing 268 (e.g., arc lengths), and the blades 264 in the section 256 are evenly spaced from one another by the third circumferential spacing 270 (e.g., arc lengths). Although each section 252, 254, and 256 has equal spacing, the circumferential spacing 266, 268, and 270 varies from one section to another. In other embodiments, the circumferential spacing may vary within each individual section. In each of these embodiments, the non-uniform blade spacing is configured to reduce the possibility of resonance due to periodic generation of wake and bow waves. Furthermore, the non-uniform blade spacing may effectively dampen and reduce the response of stationary airfoils or structures by the rotating airfoils or structure's wake and bow waves due to their non-periodic generation by the blades 264. In this manner, the non-uniform blade spacing is able to lessen the impact of wake and bow waves on various downstream components, e.g., vanes, nozzles, stators, airfoils, etc.

FIG. 5 is a perspective view of an embodiment of three rotors 280, 282, and 284, wherein each rotor has a different non-uniform spacing of blades 286. For example, the illustrated rotors 280, 282, and 284 may correspond to three stages of the compressor 152 or the turbine 154 as illustrated in FIG. 1. As illustrated, each of the rotors 280, 282, and 284 has non-uniform spacing of blades 286 between respective upper sections 288, 290, and 292 and respective lower sections 294, 296, and 298. For example, the rotor 280 includes three blades 286 in the upper section 288 and five blades 286 in the lower section 294, the rotor 282 includes four blades 286 in the upper section 290 and six blades 286 in the lower section 296, and the rotor 284 includes five blades 286 in the upper section 292 and seven blades 286 in the lower section 298. Thus, the upper sections 280, 282, and 284 have a greater number of blades 286 relative to the lower sections 294, 296, and 298 in each respective rotor 280, 282, and 284. In the illustrated embodiment, the number of blades 286 increases by one blade 286 from one upper section to another, while also increasing by one blade 286 from one lower section to another. In other embodiments, the upper and lower sections may differ in the number of blades 286 by approximately 1 to 1.005, 1 to 1.01, 1 to 1.02, 1 to 1.05, or 1 to 3 within each individual rotor and/or from one rotor to another. In addition, the blades 286 may be evenly or unevenly spaced within each section 288, 290, 292, 294, 296, and 298.

In each of these embodiments, the non-uniform blade spacing is configured to reduce the possibility of resonance due to periodic generation of wake and bow waves. Furthermore, the non-uniform blade spacing may effectively dampen and reduce the response of stationary airfoils or structures by the rotating airfoils or structure's wake and bow waves due to their non-periodic generation by the blades 286. In this manner, the non-uniform blade spacing is able to lessen the impact of wake and bow waves on various downstream components, e.g., vanes, nozzles, stators, airfoils, etc. In the embodiment of FIG. 5, the non-uniform blade spacing is provided both within each individual rotor 280, 282, and 284, and also from one rotor to another (e.g., one stage to another). Thus, the non-uniformity from one rotor to another may further reduce the possibility of resonance caused by periodic generation of wake and bow waves in a rotary machine.

Figure 6:
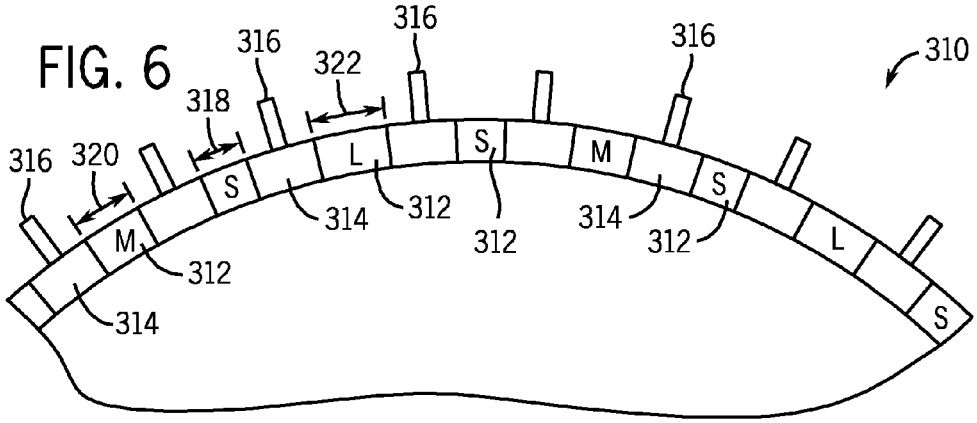
FIG. 6 is a section of a front view of an embodiment of a rotor with differently sized spacers between blades.

FIG. 6 is a section of a front view of an embodiment of a rotor 310 with differently sized spacers 312 between bases 314 of blades 316. In particular, the differently sized spacers 312 enable implementation of a variety of non-uniform blade spacing configurations with equally sized bases 314 and/or blades 316, thereby reducing manufacturing costs of the blades 316. Although any number and size of spacers 312 may be used to provide the non-uniform blade spacing, the illustrated embodiment includes three differently sized spacers 312 for purposes of discussion. The illustrated spacers 312 include a small spacer labeled as "S", a medium spacer labeled as "M", and a large spacer labeled as "L." The size of the spacers 312 may vary in a circumferential direction, as indicated by dimension 318 for the small spacer, dimension 320 for the medium spacer, and dimension 322 for the large spacer. In certain embodiments, a plurality of spacers 312 may be disposed between adjacent bases 314, wherein the spacers 312 are either of equal or different sizes. In other words, the differently sized spacers 312 may be either a one-piece construction or a multi-piece construction using a plurality of smaller spacers to generate a greater spacing. In either embodiment, the dimensions 318, 320, and 322 may progressively increase by a percentage of approximately 1 to 1000 percent, 5 to 500 percent, or 10 to 100 percent. In other embodiments, the rotor 310 may include more or fewer differently sized spacers 312, e.g., 2 to 100, 2 to 50, 2 to 25, or 2 to 10. The differently sized spacers 312 (e.g., S, M, and L) also may be arranged in a variety of repeating patterns, or they may be arranged in a random order.

Figure 7:
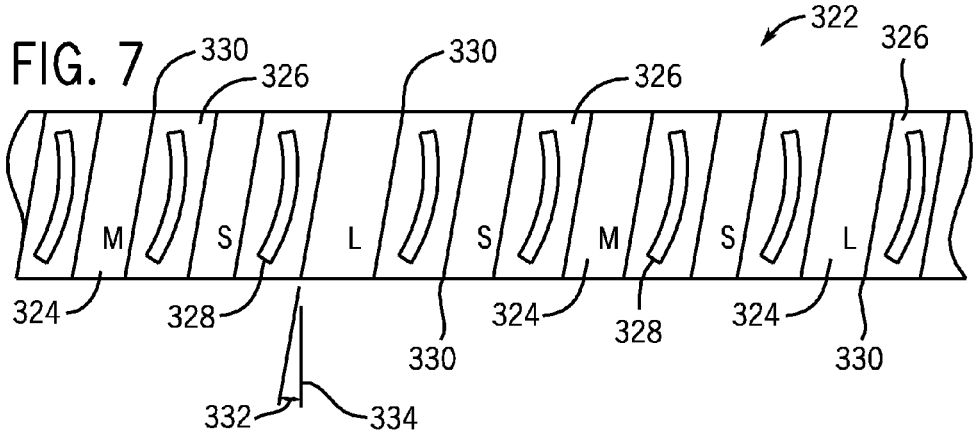
FIG. 7 is a top view of an embodiment of a rotor with differently sized spacers between blades.

FIG. 7 is a top view of an embodiment of a rotor 322 with differently sized spacers 324 between bases 326 of blades 328. Similar to the embodiment of FIG. 6, the differently sized spacers 324 enable implementation of a variety of non-uniform blade spacing configurations with equally sized bases 326 and/or blades 328, thereby reducing manufacturing costs of the blades 328. Although any number and size of spacers 324 may be used to provide the non-uniform blade spacing, the illustrated embodiment includes three differently sized spacers 324 for purposes of discussion. The illustrated spacers 324 include a small spacer labeled as "S", a medium spacer labeled as "M", and a large spacer labeled as "L." The size of the spacers 324 may vary in a circumferential direction, as discussed above with reference to FIG. 5. The differently sized spacers 324 (e.g., S, M, and L) also may be arranged in a variety of repeating patterns, or they may be arranged in a random order.

In the illustrated embodiment, the spacers 324 interface with the bases 326 of the blades 328 at an angled interface 330. For example, the angled interface 330 is oriented at an angle 332 relative to a rotational axis of the rotor 322, as indicated by line 334. The angle 332 may range between approximately 0 to 60 degrees, 5 to 45 degrees, or 10 to 30 degrees. The illustrated angled interface 330 is a straight edge or flat surface. However, other embodiments of the interface 330 may have non-straight geometries.

Figure 8:
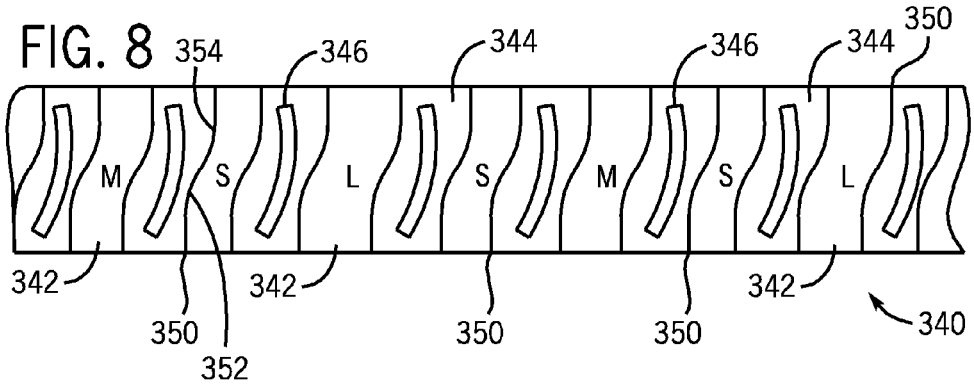
FIG. 8 is a top view of an embodiment of a rotor with differently sized spacers between blades.

FIG. 8 is a top view of an embodiment of a rotor 340 with differently sized spacers 342 between bases 344 of blades 346. Similar to the embodiment of FIGS. 6 and 8, the differently sized spacers 342 enable implementation of a variety of non-uniform blade spacing configurations with equally sized bases 344 and/or blades 346, thereby reducing manufacturing costs of the blades 346. Although any number and size of spacers 342 may be used to provide the non-uniform blade spacing, the illustrated embodiment includes three differently sized spacers 342 for purposes of discussion. The illustrated spacers 342 include a small spacer labeled as "S", a medium spacer labeled as "M", and a large spacer labeled as "L." The size of the spacers 342 may vary in a circumferential direction, as discussed above with reference to FIG. 6. The differently sized spacers 342 (e.g., S, M, and L) also may be arranged in a variety of repeating patterns, or they may be arranged in a random order.

In the illustrated embodiment, the spacers 342 interface with the bases 344 of the blades 346 at a non-straight interface 350. For example, the interface 350 may include a first curved portion 352 and a second curved portion 354, which may be the same or different from one another. However, the interface 350 also may have other non-straight geometries, such as multiple straight segments of different angles, one or more protrusions, one or more recesses, or a combination thereof. As illustrated, the first and second curved portions 352 and 354 curve in opposite directions from one another. However, the curved portions 352 and 354 may define any other curved geometry.

Figure 9:
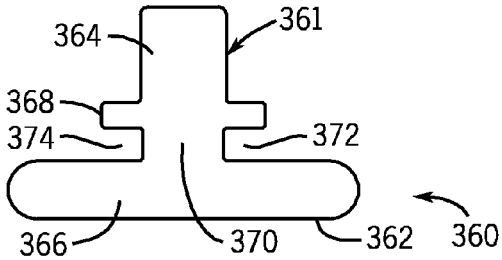
FIG. 9 is a front view of an embodiment of a blade having a T-shaped geometry.

FIG. 9 is a front view of an embodiment of a blade 360 having a T-shaped geometry 361, which may be arranged in a non-uniform blade spacing in accordance with the disclosed embodiments. The illustrated blade 360 includes a base portion 362 and a blade portion 364, which may be integral with one another (e.g., one-piece). The base portion 362 includes a first flange 366, a second flange 368 offset from the first flange 366, a neck 370 extending between the flanges 366 and 368, and opposite slots 372 and 374 disposed between the flanges 366 and 368. During assembly, the flanges 366 and 368 and slots 372 and 374 are configured to interlock with a circumferential rail structure about the rotor. In other words, the flanges 366 and 368 and slots 372 and 374 are configured to slide circumferentially into place along the rotor, thereby securing the blade 360 in the axial and radial directions. In the embodiments of FIGS. 6-8, these blades 360 may be spaced apart in the circumferential direction by a plurality of differently sized spacers having a similar base portion, thereby providing a non-uniform blade spacing of the blades 360.

Figure 10:
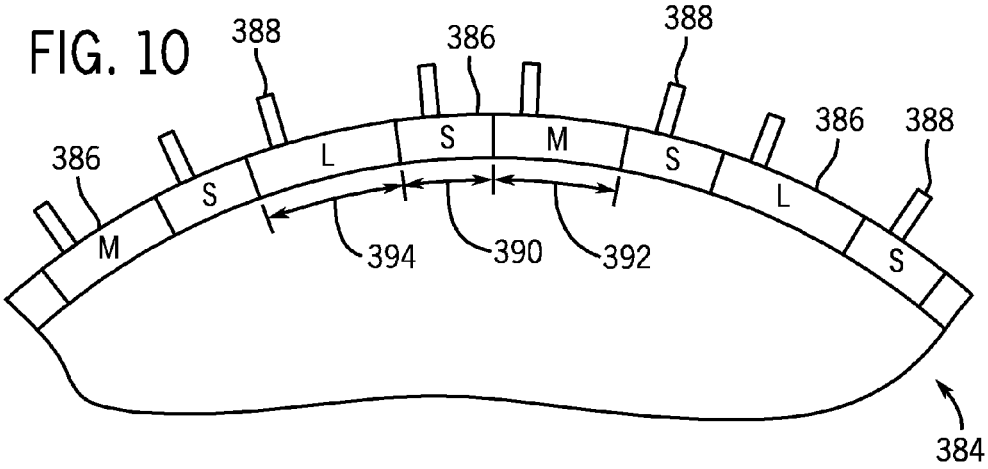
FIG. 10 is a section of a front view of an embodiment of a rotor with blades having differently sized bases.

FIG. 10 is a section of a front view of an embodiment of a rotor 384 with differently sized bases 386 of blades 388. In particular, the differently sized bases 386 enable implementation of a variety of non-uniform blade spacing configurations with or without spacers. If spacers are used with the differently sized bases 386, the spacers may be equally sized or differently sized to provide more flexibility in the non-uniform blade spacing. Although any number of differently sized bases 386 may be used to provide the non-uniform blade spacing, the illustrated embodiment includes three differently sized bases 386 for purposes of discussion. The illustrated bases 386 include a small base labeled as "S", a medium base labeled as "M", and a large base labeled as "L." The size of the bases 386 may vary in a circumferential direction, as indicated by dimension 390 for the small base, dimension 392 for the medium base, and dimension 394 for the large base. For example, these dimensions 390, 392, and 394 may progressively increase by a percentage of approximately 1 to 1000 percent, 5 to 500 percent, or 10 to 100 percent. In other embodiments, the rotor 384 may include more of fewer differently sized bases 386, e.g., 2 to 100, 2 to 50, 2 to 25, or 2 to 10. The differently sized bases 386 (e.g., S, M, and L) also may be arranged in a variety of repeating patterns, or they may be arranged in a random order.

Figure 11:
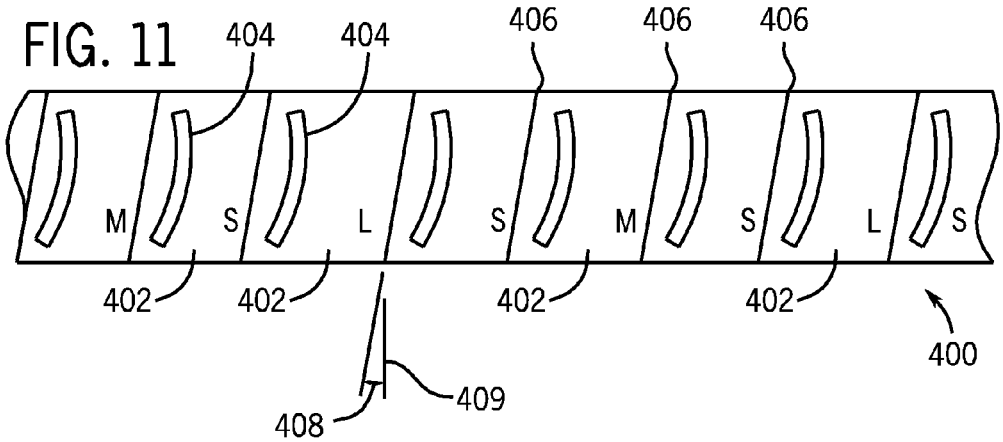
FIG. 11 is a top view of an embodiment of a rotor with blades having differently sized bases.

FIG. 11 is a top view of an embodiment of a rotor 400 with differently sized blade bases 402 supporting blades 404. Similar to the embodiment of FIG. 10, the differently sized bases 402 enable implementation of a variety of non-uniform blade spacing configurations with or without spacers. Although any number and size of bases 402 may be used to provide the non-uniform blade spacing, the illustrated embodiment includes three differently sized bases 402 for purposes of discussion. The illustrated bases 402 include a small base labeled as "S", a medium base labeled as "M", and a large base labeled as "L." The size of the bases 402 may vary in a circumferential direction, as discussed above with reference to FIG. 10. The differently sized bases 402 (e.g., S, M, and L) also may be arranged in a variety of repeating patterns, or they may be arranged in a random order.

In the illustrated embodiment, the bases 402 interface with one another at an angled interface 406. For example, the angled interface 406 is oriented at an angle 408 relative to a rotational axis of the rotor 400, as indicated by line 409. The angle 408 may range between approximately 0 to 60 degrees, 5 to 45 degrees, or 10 to 30 degrees. The illustrated angled interface 406 is a straight edge or flat surface. However, other embodiments of the interface 406 may have non-straight geometries.

Figure 12:
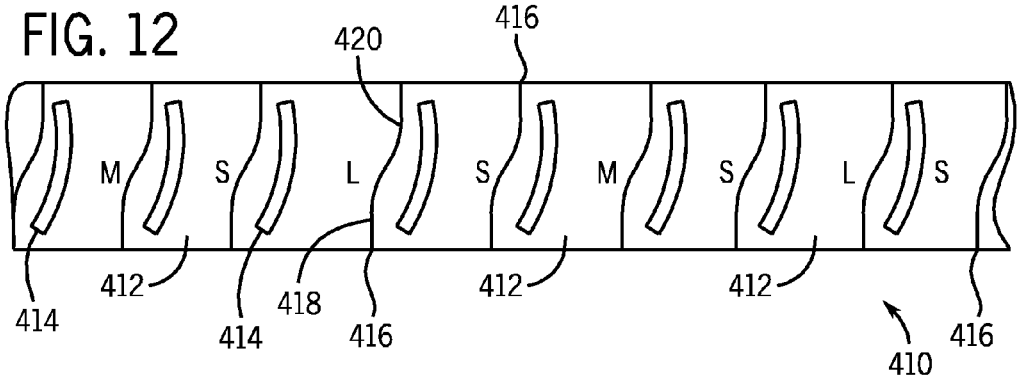
FIG. 12 is a top view of an embodiment of a rotor with blades having differently sized bases.

FIG. 12 is a top view of an embodiment of a rotor 410 with differently sized blade bases 412 supporting blades 414. Similar to the embodiment of FIGS. 10 and 12, the differently sized bases 412 enable implementation of a variety of non-uniform blade spacing configurations with or without spacers. Although any number and size of bases 412 may be used to provide the non-uniform blade spacing, the illustrated embodiment includes three differently sized bases 412 for purposes of discussion. The illustrated bases 412 include a small base labeled as "S", a medium base labeled as "M", and a large base labeled as "L." The size of the bases 412 may vary in a circumferential direction, as discussed above with reference to FIG. 10. The differently sized bases 412 (e.g., S, M, and L) also may be arranged in a variety of repeating patterns, or they may be arranged in a random order.

In the illustrated embodiment, the bases 412 interface with one another at a non-straight interface 416. For example, the interface 416 may include a first curved portion 418 and a second curved portion 420, which may be the same or different from one another. However, the interface 416 also may have other non-straight geometries, such as multiple straight segments of different angles, one or more protrusions, one or more recesses, or a combination thereof. As illustrated, the first and second curved portions 418 and 420 curve in opposite directions from one another. However, the curved portions 418 and 420 may define any other curved geometry.

Figure 13:
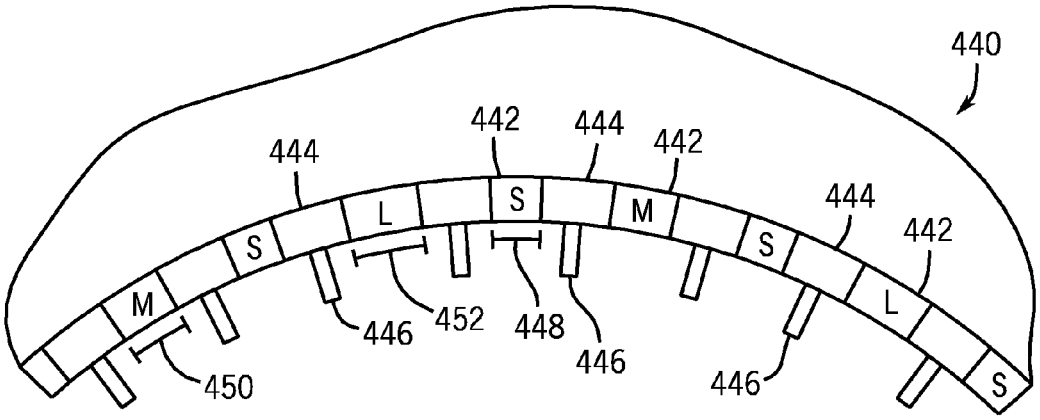
FIG. 13 is a section of a front view of an embodiment of a stator with differently sized spacers between vanes.

FIG. 13 is a section of a front view of an embodiment of a stator 440 with differently sized spacers 442 between bases 444 of vanes 446. In particular, the differently sized spacers 442 enable implementation of a variety of non-uniform vane spacing configurations with equally sized bases 444 and/or vanes 446, thereby reducing manufacturing costs of the vanes 446. Although any number and size of spacers 442 may be used to provide the non-uniform vane spacing, the illustrated embodiment includes three differently sized spacers 442 for purposes of discussion. The illustrated spacers 442 include a small spacer labeled as "S", a medium spacer labeled as "M", and a large spacer labeled as "L." The size of the spacers 442 may vary in a circumferential direction, as indicated by dimension 448 for the small spacer, dimension 450 for the medium spacer, and dimension 452 for the large spacer. In certain embodiments, a plurality of spacers 442 may be disposed between adjacent bases 444, wherein the spacers 442 are either of equal or different sizes. In other words, the differently sized spacers 442 may be either a one-piece construction or a multi-piece construction using a plurality of smaller spacers to generate a greater spacing. In either embodiment, the dimensions 448, 450, and 452 may progressively increase by a percentage of approximately 1 to 1000 percent, 5 to 500 percent, or 10 to 100 percent. In other embodiments, the stator 440 may include more or fewer differently sized spacers 442, e.g., 2 to 100, 2 to 50, 2 to 25, or 2 to 10. The differently sized spacers 442 (e.g., S, M, and L) also may be arranged in a variety of repeating patterns, or they may be arranged in a random order.

Figure 14:
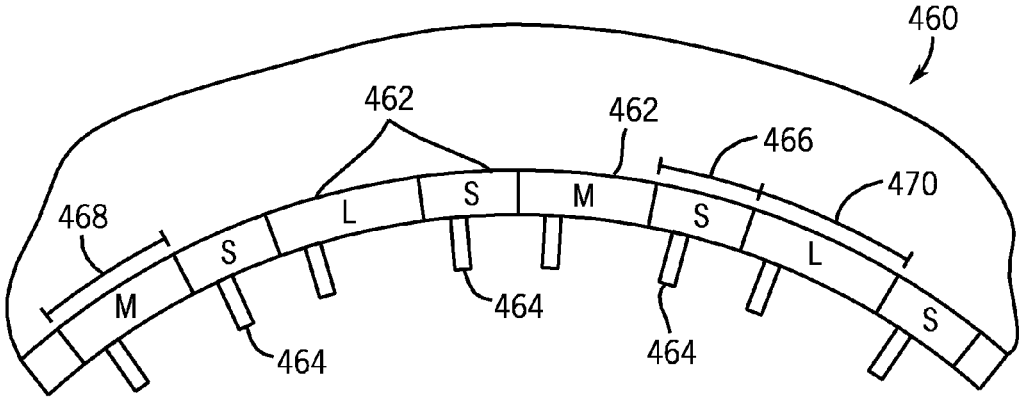
FIG. 14 is a section of a front view of an embodiment of a stator with vanes having differently sized bases.

FIG. 14 is a section of a front view of an embodiment of a stator 460 with differently sized bases 462 of vanes 464. In particular, the differently sized bases 462 enable implementation of a variety of non-uniform vane spacing configurations with or without spacers. If spacers are used with the differently sized bases 462, the spacers may be equally sized or differently sized to provide more flexibility in the non-uniform vane spacing. Although any number of differently sized bases 462 may be used to provide the non-uniform vane spacing, the illustrated embodiment includes three differently sized bases 462 for purposes of discussion. The illustrated bases 462 include a small base labeled as "S", a medium base labeled as "M", and a large base labeled as "L." The size of the bases 462 may vary in a circumferential direction, as indicated by dimension 466 for the small base, dimension 468 for the medium base, and dimension 470 for the large base. For example, these dimensions 466, 468, and 470 may progressively increase by a percentage of approximately 1 to 1000 percent, 5 to 500 percent, or 10 to 100 percent. In other embodiments, the stator 460 may include more of fewer differently sized bases 462, e.g., 2 to 100, 2 to 50, 2 to 25, or 2 to 10. The differently sized bases 462 (e.g., S, M, and L) also may be arranged in a variety of repeating patterns, or they may be arranged in a random order.

As discussed above, the present embodiments may tune the fluid dynamics in a rotary machine, such as a compressor or turbine, via an adjustment of the spacing between rotating blades or stationary vanes and/or an adjustment of the count of rotating blades or stationary vanes. This tuning may substantially reduce or eliminate the possibility of resonance behavior in the rotary machine, e.g., resonant behavior due to wake and bow waves. The embodiments of FIGS. 2-14 provide a non-uniform spacing of rotating blades or stationary vanes, specifically by changing the size of the spacers between the blade bases or by changing the size of the blade bases. The embodiments of FIGS. 15-17 specifically modify the blade and/or vane spacing, by controlling the location of mounting grooves, on a rotor or stator, that receive the blade and/or vane bases. Thus, by changing the location of the grooves on the rotors and/or stators, the spacing of the blades and/or vanes correspondingly changes, which may increase or decrease the frequency of the wake and bow waves. The change in the frequency of the wake and bow waves may increase or decrease the vibrational response of upstream and downstream structures. This frequency change may prevent a long-lasting resonant response in structures along the flow path (e.g., rotors, stators, etc.) at specific rotational speeds.

Figure 15:
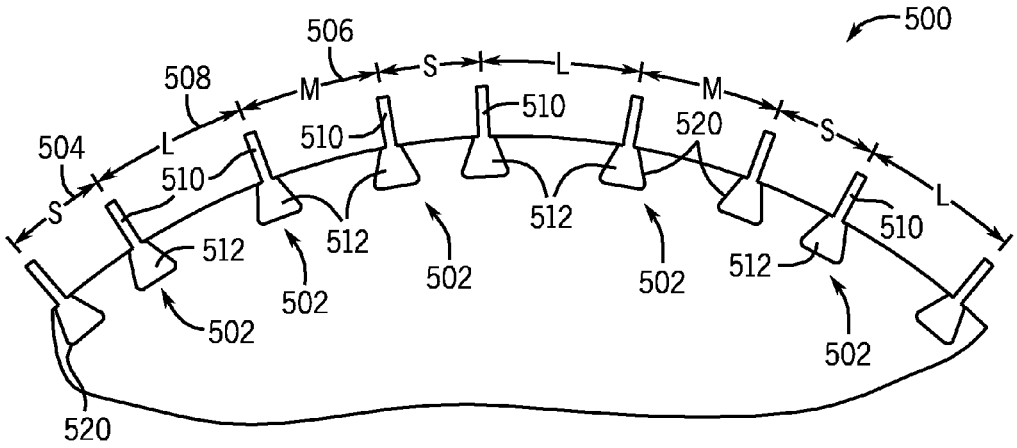
FIG. 15 is a section of a front view of an embodiment of a rotor with non-uniformly spaced grooves.

FIG. 15 is a sectional front view of an embodiment of a rotor 500 with non-uniformly spaced blade segments 502. The blade segments 502 are non-uniformly spaced about the rotor 500 by three distances 504, 506, and 508 labeled S, M, and L. The blade segments 502 define a blade 510 and a blade base 512. The blades 510 are non-uniformly spaced via non-uniform spaced grooves 520 (e.g., axial grooves) on the rotor 500. While the present embodiment illustrates only three distances, other embodiments may include more distances between the blades (e.g. 2, 3, 4, 5, 10, 1000 different distances). By varying the location and number of grooves 520 on the rotor 500 and the corresponding blade count, it is possible to change the frequency of wake and/or bow waves, which changes the vibrational response of upstream and downstream structures (i.e., limit or prevent resonant response in other structures).

Figure 16:
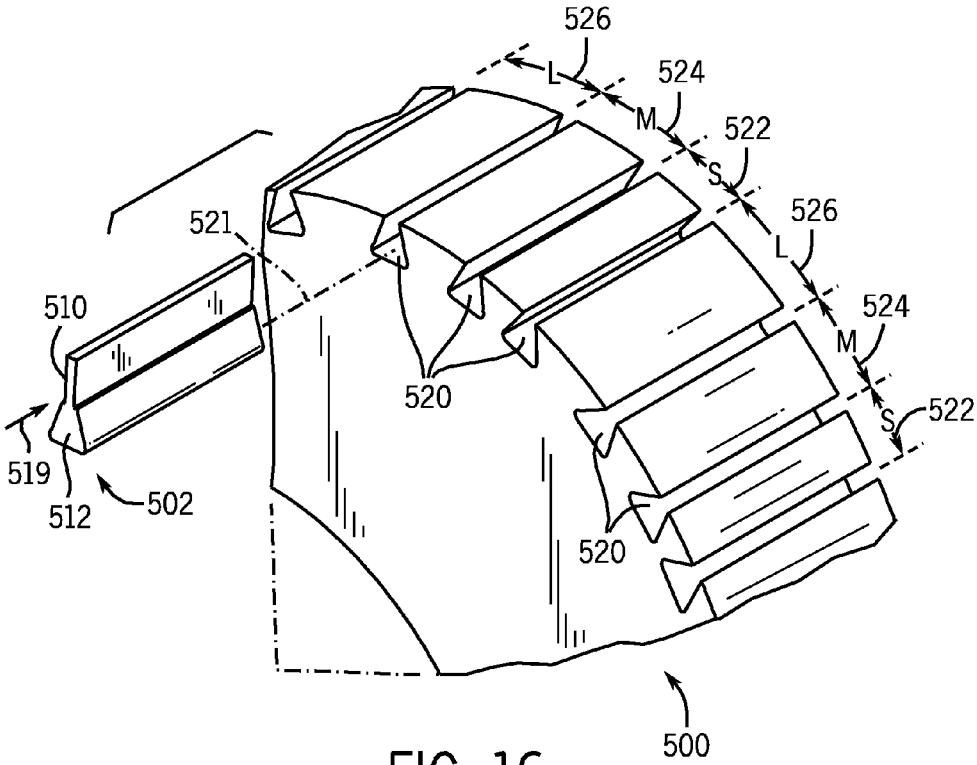
FIG. 16 is a section of a perspective view of an embodiment of a rotor with non-uniformly spaced axial grooves.

FIG. 16 is a sectional perspective view of an embodiment of the rotor 500 with non-uniformly spaced axial grooves 520, illustrating the non-uniformly spaced axial grooves 520 without the blade segments 502. Each blade segment 502 slides in an axial direction 519 into a respective groove 520 along an axis 521. For simplicity, only one blade segment 502 is shown in FIG. 16, although each groove 520 supports a blade segment 502. The variation in circumferential spacing of the grooves 520 enables non-uniform spacing of the blades 510. In the present embodiment, the grooves 520 are spaced apart in three distances small 522, medium 524, and large 526, but the grooves 520 may be spaced any number of distances (e.g. 2, 3, 4, 5, 10, 100, 1000, etc. different distances) depending on the needs of a particular design. The axial grooves 520 mate with the blade bases 512, which hold the blade segments 502 onto the rotor 500. In the present embodiment, the grooves 520 form a dovetail shape that matches the corresponding shape of the blade base 512. In other embodiments, the groove 520 may define a different shape (e.g., T-shaped, curved, circular, square, rectangular, semi-circular, etc.) that corresponds to the shape of the blade base or vice versa. Furthermore, while the present embodiment illustrates a female axial groove that connects to a male blade base, other embodiments employ a reverse configuration. For example, the rotor 500 may include a male projection, which mates with a female receptacle in the blade base 512.

Figure 17:
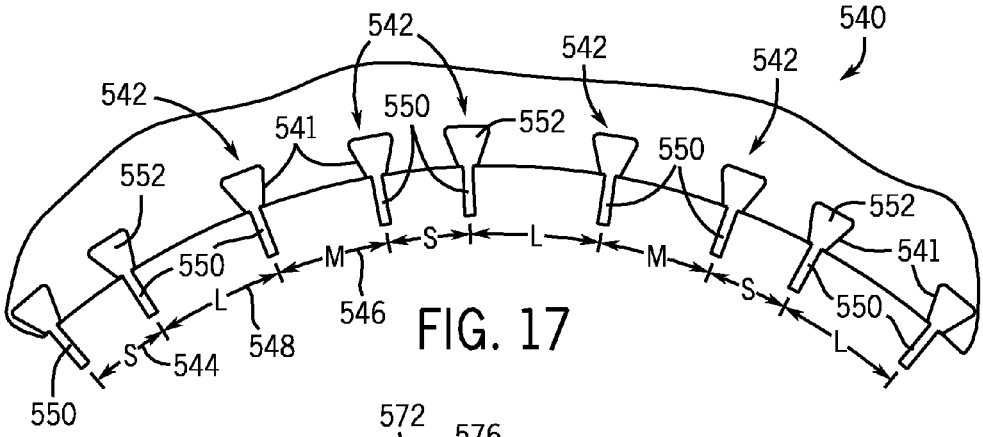
FIG. 17 is a section of a front view of an embodiment of a stator with non-uniformly spaced grooves.

FIG. 17 is a sectional front view of an embodiment of a stator 540 with non-uniformly spaced vanes. The blade segments 542 are non-uniformly spaced about the stator 540 by three distances 544, 546, and 548 correspondingly labeled S, M, and L. The blade segments 542 define a vane 550 and a vane base 552. The distances between the vanes 550 changes via non-uniformly spaced grooves 541 (e.g., dovetail shaped axial grooves) in the stator 540. While the present embodiment illustrates three distances, other embodiments may include more distances between the segments 542 (e.g. 4, 5, 6, 10, 1000 different distances). Furthermore, while the present stator 540 illustrates a female axial groove that connects to a male vane base 552, other embodiments employ a reverse configuration. For example, the stator 540 may include a male projection, which mates with a female receptacle in the vane base 562. By varying the location and number of grooves on the stator 540 and the corresponding vane count, the frequency of the wake and bow waves may increase or decrease, which changes the vibrational response of upstream and downstream structures.

Unlike the embodiments in FIGS. 15-17 that modify the blade and/or vane spacing by controlling the location of the grooves, the embodiments of FIGS. 18-22 modify the blade and/or vane spacing by controlling the placement of the blade and/or vane on its respective base. Thus, by changing the location of the blade and/or vane on the base, the spacing of the blades and/or vanes correspondingly changes, which may increase or decrease the frequency of the wake and bow waves. The change in the frequency of the wake and bow waves may increase or decrease the vibrational response of upstream and downstream structures. This frequency change may prevent a long-lasting resonant response in structures along the flow path (e.g., rotors, stators, etc.) at specific rotational speeds.

Figure 18:
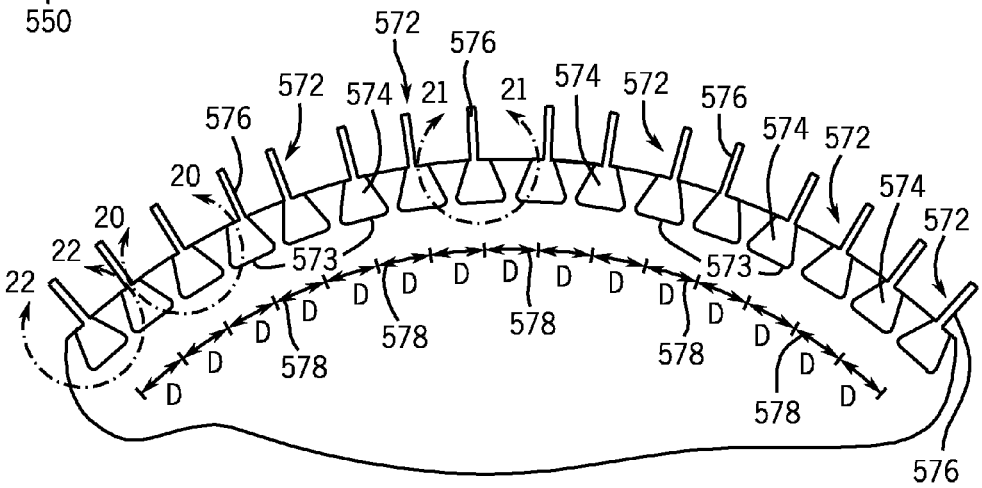
FIG. 18 is a section of a front view of an embodiment of a rotor with non-uniformly spaced blades with uniformly spaced blade bases in axial grooves.

FIG. 18 is a sectional front view of an embodiment of a rotor 570 with non-uniformly spaced blades 576 with uniformly spaced blade bases 574. The rotor 570 includes blade segments 572, each having a blade base 574 and a blade 576. The blade segments 572 connect to the rotor 570 via the bases 574, which slide axially into grooves 573 of the rotor 570. Furthermore, while the present stator 570 illustrates a female axial groove that connects to a male blade base 574, other embodiments employ a reverse configuration.

In the present embodiment of FIG. 18, the grooves 573 are uniformly spaced about the circumference of the rotor 570. The uniform spacing of the grooves 573 enables the uniform spacing of the blade bases 574, labeled as distance D 578. While the blade bases 574 are uniformly spaced along the rotor 570, the blades 576 are not uniformly spaced relative to the respective blade bases 574. As will be discussed in further detail below with respect to FIGS. 20-22, the blades 576 may be centered, shifted to the left, or shifted right of the base 574 center. As a result, it is the placement of the blades 576 on the bases 574 that creates the non-uniform spacing of the blades 576, rather than non-uniformly spacing the blades 576 via spacers, differing base sizes, or varying the location of the grooves 573 on the rotor 570. As discussed above, the non-uniform blade spacing substantially reduces or eliminates the possibility of resonance behavior in the rotary machine, caused by wake and bow waves.

Figure 19:
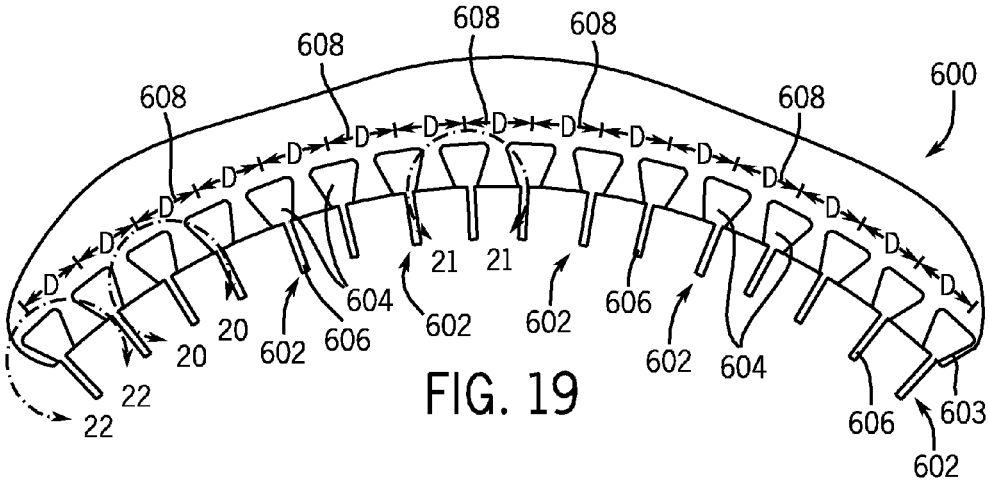
FIG. 19 is a section of a front view of an embodiment of a stator with non-uniformly spaced vanes with uniformly spaced vane bases in axial grooves.

FIG. 19 is a sectional front view of an embodiment of a stator 600 with non-uniformly spaced vanes 606 with uniformly spaced vane bases 604. Similar to the discussion above with respect to the rotor 570 illustrated in FIG. 18, the stator 600 includes blade segments 602 each having a base 604 and a vane 606. The blade segments 602 connect to the stator 600 via the bases 604, which slide axially into grooves 603 of the stator 600. Furthermore, while the present stator 600 illustrates a female axial groove that connects to a male vane base 604, other embodiments employ a reverse configuration.

In the present embodiment of FIG. 19, the grooves 603 are uniformly spaced about the circumference of the stator 600. The uniform spacing of the grooves 603 enables the uniform spacing of the bases 604, labeled as distance D 608. While the vane bases 604, are uniformly spaced along the stator 600, the vanes 606 are not uniformly spaced relative to the respective bases 604. As illustrated in FIG. 19, some of the vanes 606 are centered on their respective bases 604 (i.e., center of bases), while others are shifted to the left or right of the base 604 centers. Thus, it is the placement of the vanes 606 on the bases 604 that creates the non-uniform spacing of the vanes 606, rather than non-uniformly spacing the vanes 606 via spacers, differing base sizes, or the varying location of the grooves 603 on the stator 600. The non-uniform vane spacing substantially reduces or eliminates the possibility of resonance behavior in the rotary machine, caused by wake and bow waves.

Figure 20:
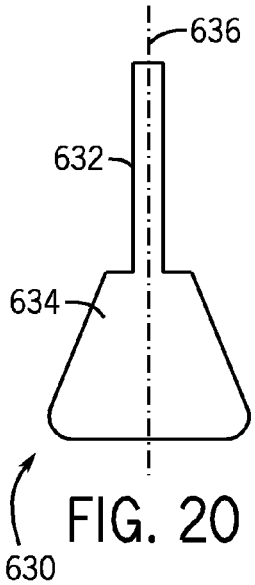
FIG. 20 is a front view of an embodiment of a blade segment with the blade centered on the blade base.
Figure 21:
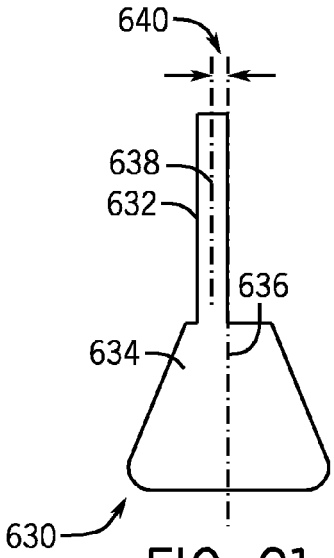
FIG. 21 is a front view of an embodiment of a blade segment with the blade shifted to the left of the blade base center.
Figure 22:
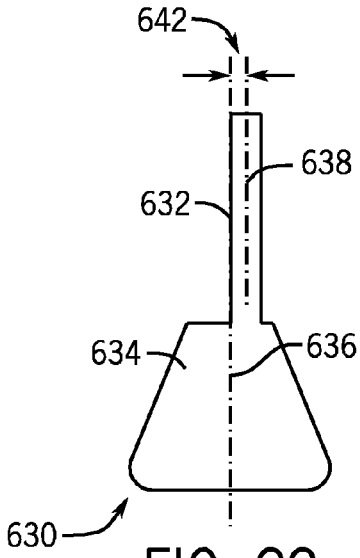
FIG. 22 is a front view of an embodiment of a blade segment with the blade shifted to the right of the blade base center.

FIG. 20 is a front view of an embodiment of a blade segment taken within lines 20-20 of FIGS. 18 and 19. As illustrated, the blade segment 630 has a blade 632 centered on a blade base 634. Specifically, the center of the blade 632 aligns with the center of the base 634 as illustrated by centerline 636. FIG. 21 is a front view of an embodiment of a blade segment taken within lines 21-21 of FIGS. 18 and 19. As illustrated, the blade segment 630 has the blade 632 shifted to the left of the centerline 636 of the blade base 634. More specifically, the center of the blade 632 illustrated by centerline 638 is offset from the base centerline 636 by a distance 640. FIG. 22 is a front view of an embodiment of a blade segment taken within lines 22-22 of FIGS. 18 and 19. As illustrated, the blade segment 630 has the blade 632 shifted to the right of the centerline 636 of the blade base 634. That is, the center of the blade 632 illustrated by centerline 638 is offset from the base centerline 636 by a distance 642. While FIGS. 20-22 only illustrate three positions of the blade 632 with respect to the blade base 634, various embodiments may employ any number of positions (e.g., 1, 2, 3, 4, 5, 6, 7, 8, 9, 10, or more) of the blade 632 with respect to the base 634. In this manner, the different blade segments 630 (e.g., with different blade positions) can be incorporated into a rotor and/or stator to create non-uniform blade spacing, while maintaining uniform spacing of the grooves on the rotor and/or stator. As discussed above, the non-uniform vane/blade spacing substantially reduces or eliminates the possibility of resonance behavior in the rotary machine, caused by wake and bow waves.

Figure 23:
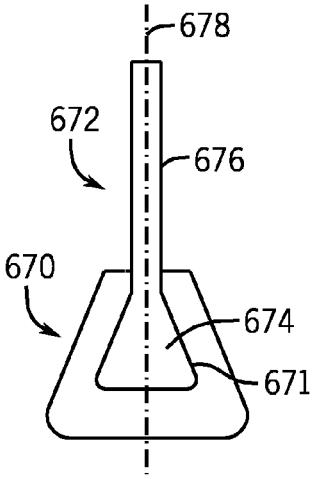
FIG. 23 is a front view of an embodiment of a blade mounting adapter and a blade segment mounted within the blade mounting adapter, wherein the blade segment is centered within the blade mounting adapter.
Figure 24:
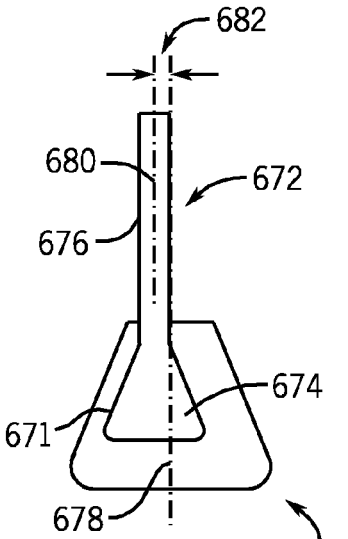
FIG. 24 is a front view of an embodiment of a blade mounting adapter and a blade segment within the blade mounting adapter, wherein the blade segment is shifted to the left of the blade mounting adapter center.
Figure 25:
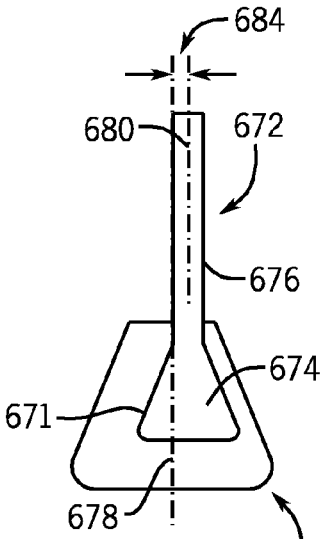
FIG. 25 is a front view of an embodiment of a blade mounting adapter and a blade segment within the blade mounting adapter, wherein the blade segment is shifted to the right of the blade mounting adapter center.

In some embodiments, a mounting adapter may be employed to enable non-uniform spacing of blades and/or vanes. FIGS. 23-25 illustrate blade segments 672 disposed in blade mounting adapter 670, which may be axially mounted into grooves of the rotor 570 or stator 600 of FIGS. 18 and 19. The blade mounting adapter 670 allows for uniform spacing of the grooves on a stator and/or a rotor, while simultaneously permitting non-uniform blade spacing to change the frequency of the wake and bow waves. The change in the frequency of the wake and bow waves may increase or decrease the vibrational response of upstream and downstream structures. This frequency change may prevent a long-lasting resonant response in structures along the flow path (e.g., rotors, stators, etc.) at specific rotational speeds.

FIG. 23 is a front view of an embodiment of a blade mounting adapter 670 and a blade segment 672 mounted within the blade mounting adapter 670, wherein the blade segment 672 is centered within the blade mounting adapter 670. The blade mounting adapter 670, of the illustrated embodiment, defines a dovetail shape for insertion into a groove of a stator and/or rotor. While the present embodiment illustrates a dovetail shape, it is understood that the blade mounting adapter 670 may assume a variety of shapes (e.g., T-shaped, curved, circular, semi-circular, square, rectangular, etc.) depending on the shape of the groove in the rotor and/or stator. Furthermore, the blade mounting adapter 670 defines a cavity 671 within which the blade segment 672 fits. While the present embodiment illustrates a blade mounting adapter 670 with the cavity 671 to receive the blade segment 672, other embodiments of the blade mounting adapter 670 may define a male portion that connects to a female portion of a blade segment 672.

Similar to the embodiments discussed above, the blade segment 672 includes a blade base 674 and a blade 676. The blade base 674 fits into the cavity 671 of the blade mounting adapter 670. In this manner, the blade mounting adapter 670 holds the blade segment 672 into place on a stator and/or rotor. In the embodiment of FIG. 23, the center of the blade segment 672 aligns with the center of the blade mounting adapter 670, illustrated by a centerline 678. The centered positioning of FIG. 23 is achieved by a centered positioning of the cavity 671 relative to the centerline 678 in the adapter 670.

FIG. 24 is a front view of an embodiment of a blade mounting adapter 670 and a blade segment 672 within the blade mounting adapter 670. In FIG. 24, the blade segment 672 shifts to the left of the centerline 678 of the adapter 670. Specifically, the center of the blade segment 672 illustrated by centerline 680 is offset from the centerline 678 by a distance 682. The offcenter (e.g., left offset distance 682) positioning of the blade segment 672 is achieved by an offcenter positioning of the left cavity 671 relative to the centerline 678 in the adapter 670. In other words, the adapter 670 provides the offcenter positioning, while the blade segment 672 may be a uniform blade segment and the mounting grooves may be uniformly spaced. Accordingly, when the blade segment 672 is placed within the cavity 671 of the blade mounting adapter 670, the blade segment 672 is shifted to the left. Similarly, FIG. 25 is a front view of an embodiment of a blade mounting adapter 670 and a blade segment 672 within the blade mounting adapter 670, wherein the blade segment 672 is shifted to the right of the blade mounting adapter centerline 678. As illustrated, the center of the blade segment 672, illustrated by centerline 680, shifts to the right of the centerline 678 by a distance 684. Again, like FIG. 24, is the location of the cavity 671 within the blade mounting adapter 670 that shifts the blade segment 672 towards the right. In this manner, the blade mounting adapter 670 facilitates non-uniform blade spacing about a rotor and/or stator.

Technical effects of the disclosed embodiments of the invention include the ability to non-uniformly space blades (or vanes) in a rotary machine, such as a compressor or a turbine. The non-uniform blade spacing may be achieved with differently sized spacers between adjacent blades, differently sized bases supporting blades, non-uniformly spaced grooves about a stator and/or rotor, blades that are placed at various positions on the bases, blade mounting adapters that shift complete blade segments, or a combination thereof. The non-uniform blade spacing may also be applied to multiple stages of a rotary machine, such as multiple turbine stages or multiple compressor stages. For example, each stage may have non-uniform blade spacing, which may be the same or different from other stages. In each of these embodiments, the non-uniform blade spacing is configured to reduce the possibility of resonance due to periodic generation of wake and bow waves. Furthermore, the non-uniform blade spacing may effectively dampen and reduce the response of rotating and stationary airfoils or structures caused by wake and bow waves. In this manner, the non-uniform blade spacing is able to lessen the impact of wake and bow waves on various upstream and downstream components, e.g., vanes, nozzles, stators, airfoils, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a rotary machine comprising:

a stator;

a rotor configured to rotate relative to the stator;

a plurality of axial grooves disposed along a circumference of the stator or the rotor;

a plurality of blade segments disposed along the circumference, wherein each blade segment of the plurality of blade segments comprises a blade coupled to a mounting base; and a plurality of non-uniform blade mounting adapters each disposed between a respective axial groove of the plurality of axial grooves and a respective mounting base of the plurality of blade segments, wherein the plurality of blade segments has a non-uniform blade spacing about the circumference.

2. The system of claim 1, wherein the plurality of axial grooves has a non-uniform groove spacing about the circumference.

3. The system of claim 1, wherein the plurality of blade segments comprises a plurality of non-uniform blade segments, each non-uniform blade segment has a different position of a respective blade on a respective mounting base.

4. The system of claim 3, wherein the plurality of non-uniform blade segments comprises a first non-uniform blade segment having a first blade coupled to a first mounting base at a first distance relative to a first centerline of the first mounting base, the plurality of non-uniform blade segments comprises a second non-uniform blade segment having a second blade coupled to a second mounting base at a second distance relative to a second centerline of the second mounting base, and the first and second distances are different from one another.

5. The system of claim 1, wherein the plurality of non-uniform blade mounting adapters comprises a first adapter having a first mount receptacle at a first distance relative to a first centerline of the first adapter, the plurality of non-uniform blade mounting adapters comprises a second adapter having a second mount receptacle at a second distance relative to a second centerline of the second adapter, and the first and second distances are different from one another.

6. The system of claim 1, wherein the plurality of axial grooves is disposed along the circumference of the stator.

7. The system of claim 1, wherein the plurality of axial grooves is disposed along the circumference of the rotor.

8. The system of claim 1, wherein the rotary machine comprises a compressor.

9. The system of claim 1, wherein the rotary machine comprises a turbine.

10. A system, comprising:

a rotary machine comprising:

a plurality of first axial mounts disposed circumferentially about a rotational axis;

a plurality of second axial mounts disposed circumferentially about the rotational axis, wherein each first axial mount of the plurality of first axial mounts couples with a respective second axial mount of the plurality of second axial mounts in an axial direction along the rotational axis;

a plurality of non-uniform blade mounting adapters, wherein each adapter of the plurality of non-uniform blade mounting adapters is disposed between a respective first axial mount and a respective second axial mount; and a plurality of blades coupled to the plurality of second axial mounts, wherein the plurality of blades has a non-uniform blade spacing circumferentially about the rotational axis.

11. The system of claim 10, wherein each first axial mount of the plurality of first axial mounts comprises a female mount, and each second axial mount of the plurality of second axial mounts comprises a male mount.

12. The system of claim 10, wherein each first axial mount of the plurality of first axial mounts comprises a male mount, and each second axial mount of the plurality of second axial mounts comprises a female mount.

13. The system of claim 10, wherein the plurality of first axial mounts has a non-uniform mount spacing circumferentially about the rotational axis.

14. The system of claim 10, wherein the plurality of blades is disposed at a plurality of different circumferential positions on the plurality of second axial mounts.

15. The system of claim 10, wherein the rotary machine comprises a compressor or a turbine.

16. A system, comprising:

a turbo machine comprising:

a stator;

a rotor configured to rotate relative to the stator;

a plurality of axial grooves disposed along a circumference of the rotor; and a plurality of non-uniform blade segments each having only one blade coupled to only one mounting base, wherein each blade segment of the plurality of non-uniform blade segments has a different position of the one blade with respect to the one mounting base, and each blade segment of the plurality of non-uniform blade segments couples to one axial groove of the plurality of axial grooves.

17. The system of claim 16, wherein the plurality of axial grooves has a non-uniform groove spacing about the circumference.

18. The system of claim 16, wherein the plurality of axial grooves has a uniform groove spacing about the circumference, and the non-uniform blade spacing is defined by non-uniform positioning of the plurality of blades in the plurality of axial grooves.

* * * * *